US007316450B2

(12) United States Patent
Ayers et al.

(10) Patent No.: US 7,316,450 B2
(45) Date of Patent: Jan. 8, 2008

(54) FOLDABLE COVER FOR THE OVERHEAD PROTECTION OF AN OCCUPANT OF A WHEELCHAIR OR OTHER WHEELED VEHICLE

(76) Inventors: Ronald Lee Ayers, 364 Beemer Ave., Sunnyvale, CA (US) 94086; Ada Marie Bull, 324 Angel Ave., Sunnyvale, CA (US) 94086

( * ) Notice: Subject to any disclaimer, the term of this patent is extended or adjusted under 35 U.S.C. 154(b) by 51 days.

(21) Appl. No.: 11/188,291

(22) Filed: Jul. 22, 2005

(65) Prior Publication Data

US 2007/0018486 A1 Jan. 25, 2007

(51) Int. Cl.
*E04H 15/06* (2006.01)

(52) U.S. Cl. ..... 297/184.15

(58) Field of Classification Search ..... 297/184.1, 297/184.15, 188.06, 188.2; 135/88.1, 88.12, 135/90, 96, 117, 119
See application file for complete search history.

(56) References Cited

U.S. PATENT DOCUMENTS 3,243,230 A * 3/1966 Otto ..... 297/184.15
3,404,915 A * 10/1968 De Souza Filho ..... 297/17
4,201,416 A * 5/1980 Vanderminden ..... 297/184.15
4,389,057 A 6/1983 Richard, Jr.
4,643,479 A 2/1987 Servi
4,687,249 A * 8/1987 Mills ..... 297/184.15
4,865,381 A * 9/1989 Van Rogue ..... 297/184.15
5,096,257 A * 3/1992 Clark ..... 297/184.15
5,168,889 A 12/1992 Diestel
5,203,363 A * 4/1993 Kidwell et al. ..... 135/90
5,797,650 A * 8/1998 Gonzalez et al. ..... 297/184.1
5,921,258 A 7/1999 Francois
6,308,722 B1 10/2001 Christie
6,378,539 B1 4/2002 Allee
6,789,557 B1 * 9/2004 Wahl, Jr. ..... 135/154

* cited by examiner

*Primary Examiner*—Peter R. Brown
(74) *Attorney, Agent, or Firm*—Schneck & Schneck

(57) ABSTRACT

Two embodiments of a foldable cover for protecting the occupant of a wheelchair or other wheeled vehicle is described. The foldable cover includes a frame having two sections, a back section and a top section cantileverable from the back section over the normal space provided for an occupant. A mounting bar for rigidly mounting the back section and, hence, the remainder of the foldable cover is provided with both embodiments. The back section is pivotally connected to the mounting bar for pivoting movement between a stowed position in which such cover is out of the way of the occupant in a protected position in which it and the cantilevered top section cooperate to cover the occupant.

16 Claims, 9 Drawing Sheets

FOLDABLE COVER FOR THE OVERHEAD PROTECTION OF AN OCCUPANT OF A WHEELCHAIR OR OTHER WHEELED VEHICLE

BACKGROUND OF THE INVENTION

This invention relates to a cover for the overhead protection of an occupant of a wheelchair or other wheeled vehicle and, more particularly, to such a cover which is foldable and storable on the vehicle when not in use and includes many features which are quite attractive to a disabled occupant.

Most wheelchairs or other wheeled vehicles designed for disabled occupants do not include a cover providing overhead protection for the occupant. While covers have been designed in the past, none has been acceptable in the marketplace for various reasons. The result of this lack of adequate covers is that many disabled do not venture out if the existing or potential weather is not conducive to uncovered travel.

SUMMARY OF THE INVENTION

The present invention provides a foldable cover for protecting the occupant of a wheelchair or other wheeled vehicle. It can be stowed when not in use on the wheelchair itself.

In its basic aspects, the foldable cover of the invention includes a frame having at least two sections, a back section and a top section cantileverable from the back section over the normal space provided for the occupant. It most desirably further includes a mounting bar for rigidly mounting the back section and, hence, the remainder of the foldable cover, to the vehicle.

Although the mounting bar acts to rigidly secure the cover to a wheeled vehicle such as a wheelchair, the back section is pivotally connected to the mounting bar for pivoting between a stowed position in which such cover is out-of-the-way of the occupant and a protective position in which said back section and the cantilevered top section cooperate to cover the occupant. The stowed or storable position is one which is selected to facilitate erection. The cover of the invention also includes a flexible covering which is supported by the frame sections.

The cantilever arrangement is most simply provided by the hinge securance including an interference position between frame members in the path of pivoting of the top section relative to the back section. The result is that the cantilevering is provided automatically when the top and back sections are pivotally moved relative to one another.

One feature of the invention is that at least part of the top section has a transverse width sized to fit within the transverse width of the back section. This geometric arrangement facilitates the collapsing of the frame to enable the foldable cover to be positioned in the stowed position.

The invention includes other features and advantages which will be described or will become apparent from the following more detailed description of preferred embodiments.

BRIEF DESCRIPTION OF THE DRAWINGS

With reference to the accompanying drawings.

DETAILED DESCRIPTION OF PREFERRED EMBODIMENTS

The following, relatively detailed description is provided to satisfy the patent statutes. It will be appreciated by those skilled in the art, though, that various changes and modifications can be made without departing from the invention.

Figure 1:
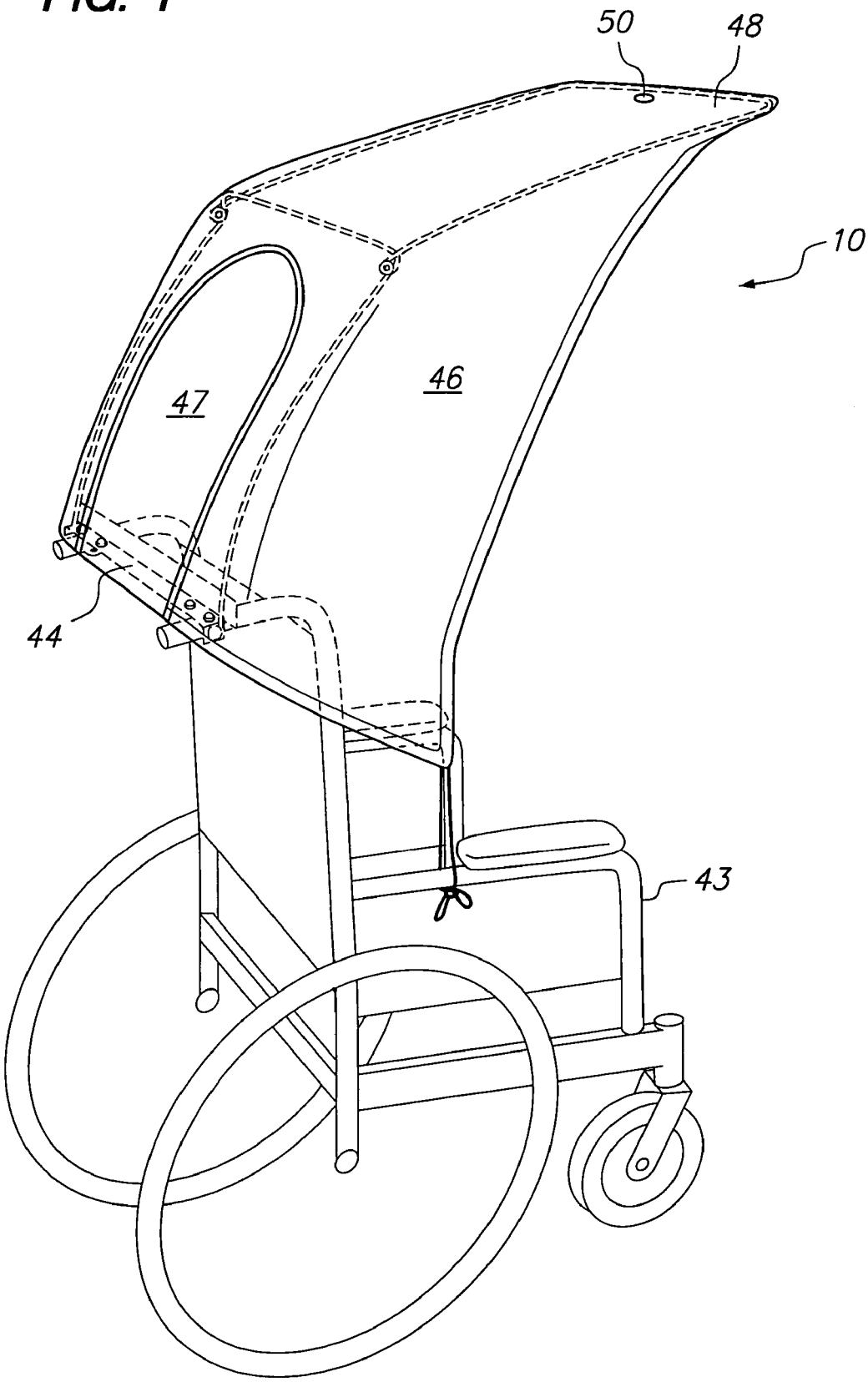
FIG. 1 is an isometric view of an embodiment of a foldable cover of the invention that is lightweight, the cover of the embodiment being shown in its erected position providing overhead protection for an occupant.

FIG. 1 shows a preferred embodiment of the invention in combination with a standard push-type wheelchair. It can be seen how the foldable cover of the invention extends over the space provided for the occupant. Many of the principles of the invention, though, can best be understood from a description of the preferred embodiment of FIG. 2. With reference to such figure, the foldable cover 11 of this embodiment is an after market item attached to a motorized wheelchair 12. Such chair includes, as is typical, a pair of powered wheels 13 and a pair of front stabilizing wheels 14. A platform 16 is provided, separating the occupant space of the chair from the mechanics which result in the powering of the wheels. Although not shown in detail since the mechanics forms no part of the invention, such mechanics include a battery pack and motor represented at 17.

The occupant space is defined by a chair having a back 18, two arms 19, and the usual footrests 21.

In accordance with normal practice, the chair 12 also includes a pair of push handles 22. It is to these push handles that the foldable cover of the invention is rigidly secured via an intermediate mount bar 23.

Figure 3:
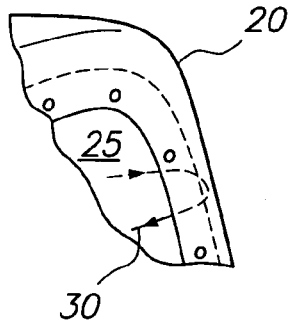
FIG. 3 is an enlarged partial view of the covering of the embodiment of FIG. 2 showing an air vent.

The foldable cover is made up of a frame 15 (described in more detail hereinafter), supporting a covering 20. The covering 20 is generally opaque although it could be transparent. In this embodiment it is generally opaque with a transparent window at the location for the back of the head of an occupant of the wheelchair. Such covering also defines small air vents at the location of the window to enable air to escape and thus prevent pressure buildup from occurring within the covering and interfering with its location over the space defined for an occupant. This is shown in FIG. 3 in which it is illustrated that air represented by arrow 30 is flowable between securing window fasteners from the interior of the covering to the exterior.

Figure 8:
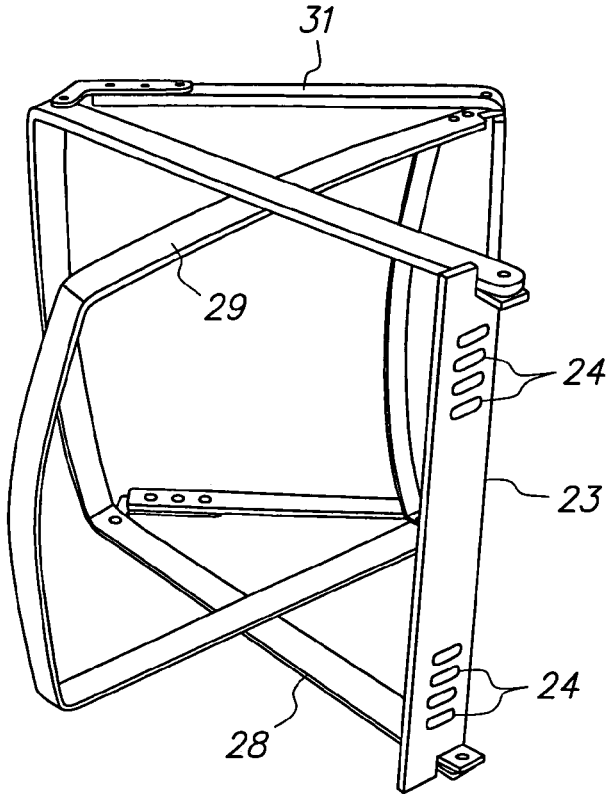
FIG. 8 is an isometric view of the frame of FIG. 7 showing the frame in a partially collapsed position with a component of top section fitting within the back section.

As mentioned previously, the foldable cover of this embodiment is an after market item. It is for this reason that the mount bar 23 is provided. This mount bar 23 extends between the push handles 22 and is rigidly secured in front of the portion of the same designed to receive the hands of a pusher. As is best illustrated in FIG. 8, the mount bar 23 includes a plurality of slots 24 at two separated locations corresponding to the locations of the push bars. Each group of slots accommodates a strap 26 or U bolt which passes about the associated handle bar and provides a rigid securance to the chair.

Although both embodiments being described have mount bars, such a bar is really not necessary when one considers the basic aspects of the instant invention. From the broad standpoint, the foldable cover need not be an after market item and could be integrated into the chair itself with the result that the mounting bar is not needed. Even when the cover is integrated into the chair itself, it is rigidly securable to the chair. However, it is important is that the cover frame be pivotally connected for switching between a stowed or stored position on the wheelchair and a protective position in which it covers the occupant's space.

The stowed or stored position is selected to facilitate erection of the cover. While it is recognized that many disabled will not be able to erect the cover (or covers of any design at all), this position facilitates erection and permits erection by some disabled.

Figure 2:
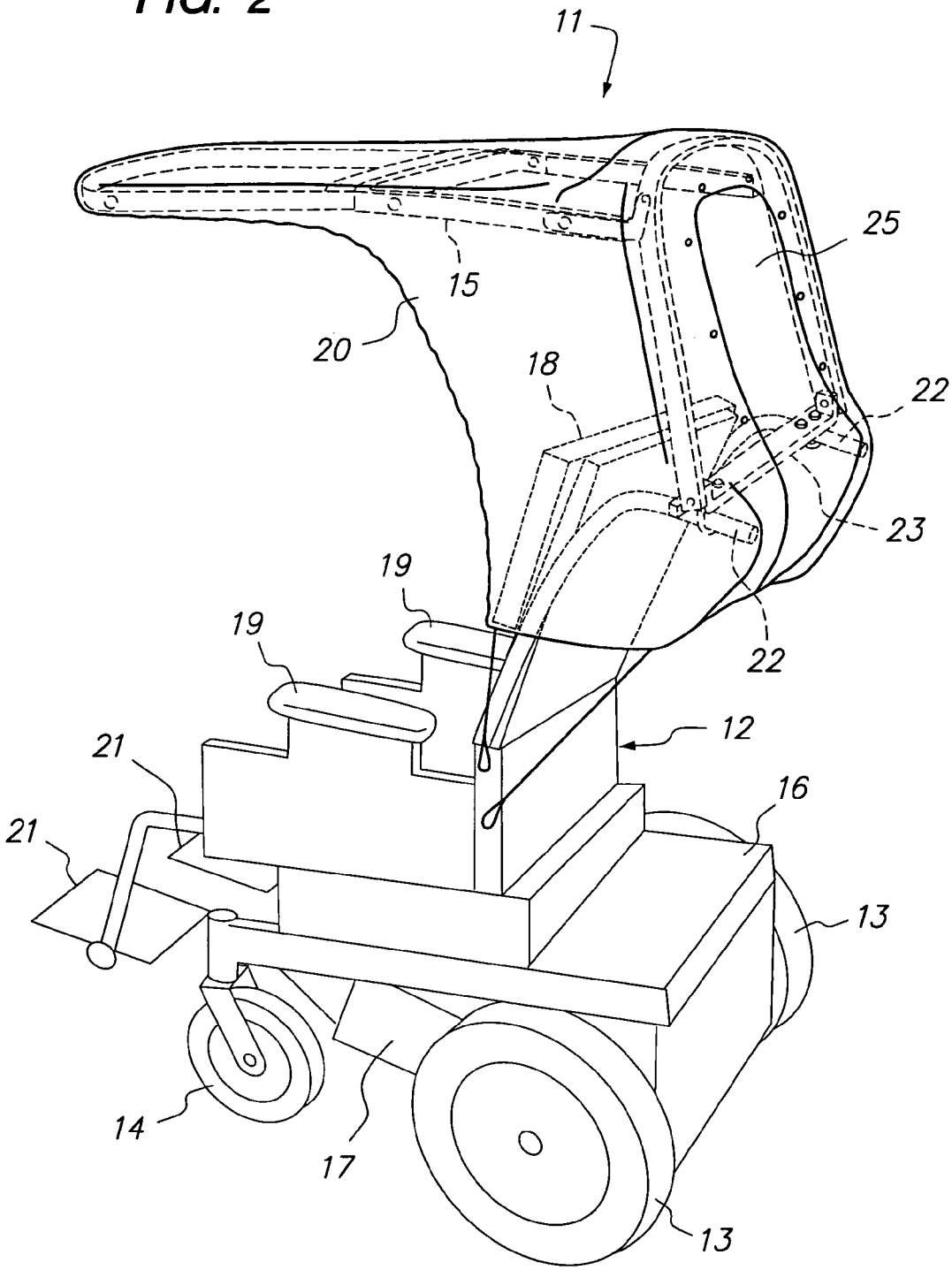
FIG. 2 is an isometric view of another embodiment of a foldable cover of the invention installed on a motorized wheelchair.
Figure 7:
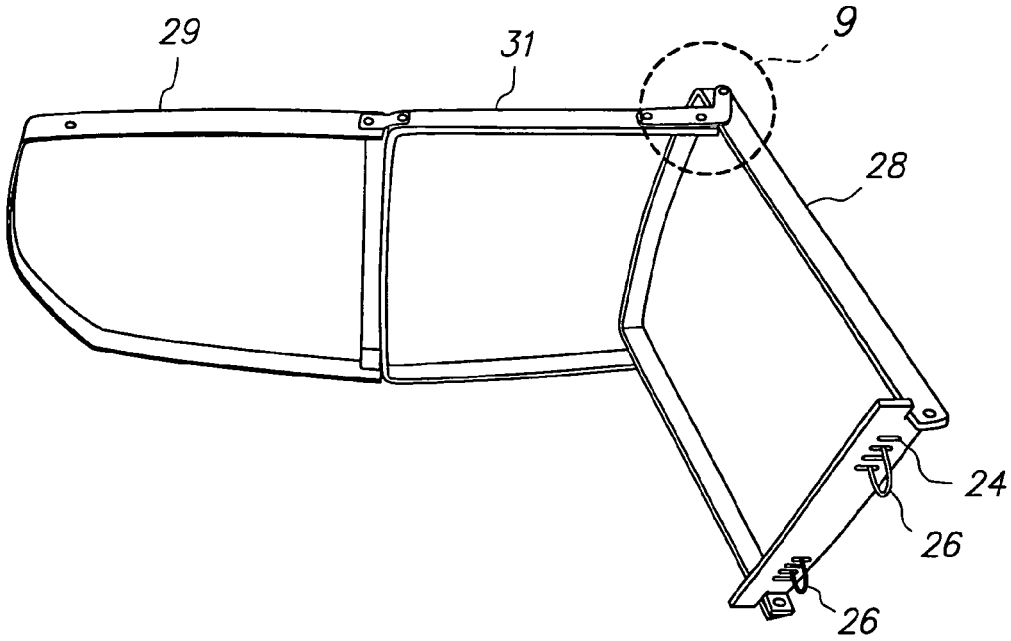
FIG. 7 is an isometric view of the frame arrangement of the embodiment of FIG. 2.

In the embodiment of FIG. 2 being described, the frame is shown in its entirety in FIG. 7 and is made up of a plurality of polyethylene plastic bars. It includes a back section 28 and two top section components, a front section component 29 and a midsection component 31.

When the cover of the invention is moved to its stowed position, the front frame component 29 fits within the back section 28. That is, the transverse width of the front section 29 is less than the transverse width of the back section to accommodate such an arrangement, helping to provide the cover in a compact, collapsed condition when it is in its stored position.

Another important feature of the invention is that the cover extends over the full occupant space. In this connection, in this embodiment the top section made up of its components 29 and 31 are cantilevered from the back section 28. This is facilitated by including a hinged securance of the top midsection component to the back section with an interference position. This midsection is sandwiched between the back section and the front section component. When the cover is erected, this front component is, in essence, an extension of the midsection component so that the two top components are serially cantilevered from the back section.

Figure 9:
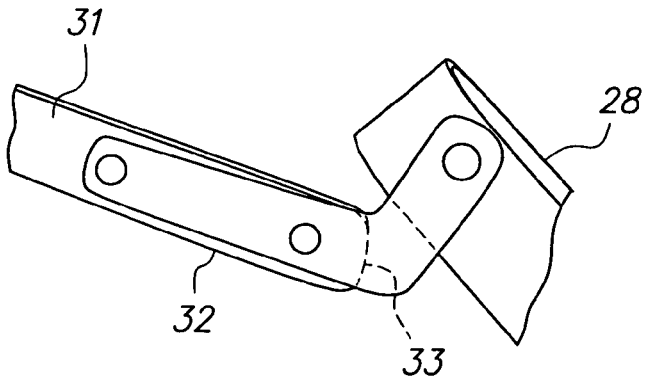
FIG. 9 is an enlarged isometric view of the hinge securance between the back section and the midsection component of the frame the top section of the embodiment of FIG. 2, said view generally being encircled in FIG. 7.

The relationship resulting in the interference position for this embodiment is best illustrated in FIG. 9. Such figure is a blow-up of a portion of the frame shown in FIG. 7, but in a somewhat different position. As illustrated, the back section 28 and midsection 31 are hingedly connected together by an L-shaped hinge 32. However, the end 33 of the frame piece 31 is designed to abut against the frame piece 28 and thus provide the interference position which results in the cantilevering of the midsection frame and, hence, the full top section from the back section as desired.

Figure 4:
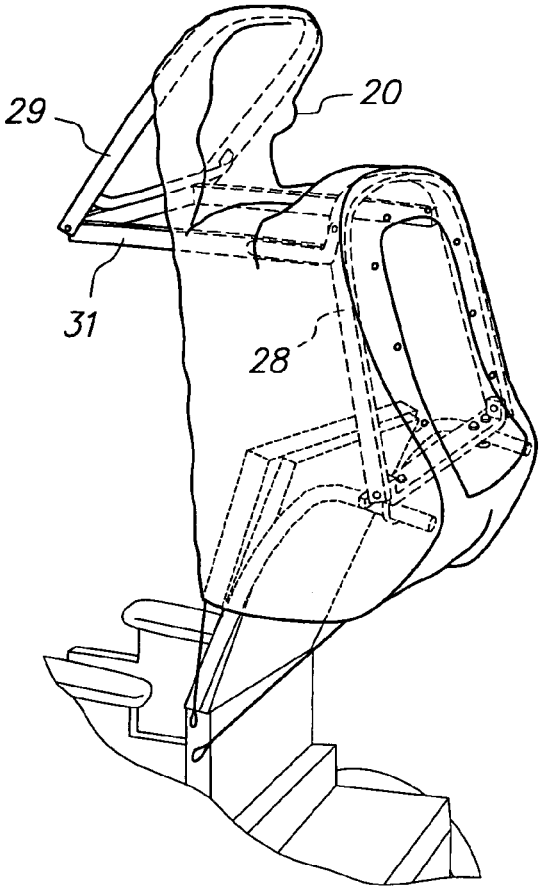
FIGS. 4 and 5 are partial isometric views showing the embodiment of FIG. 2 in stages of being moved to its stowed position.
Figure 5:
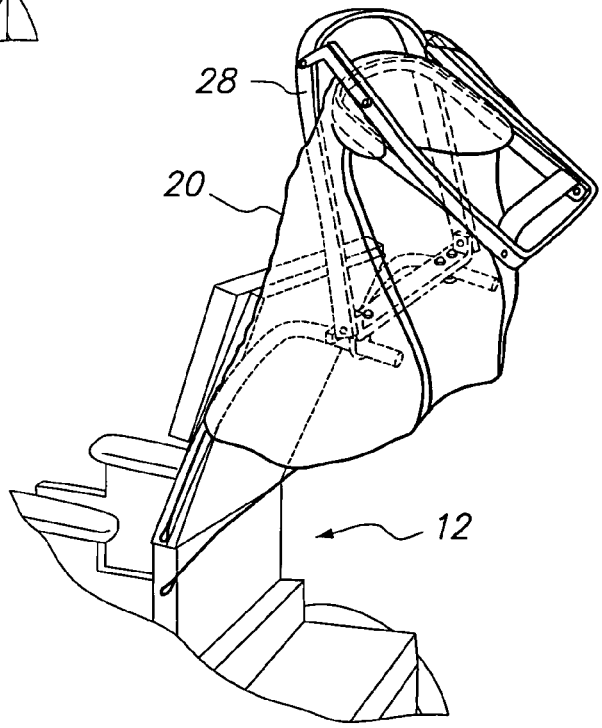
Figure 6:
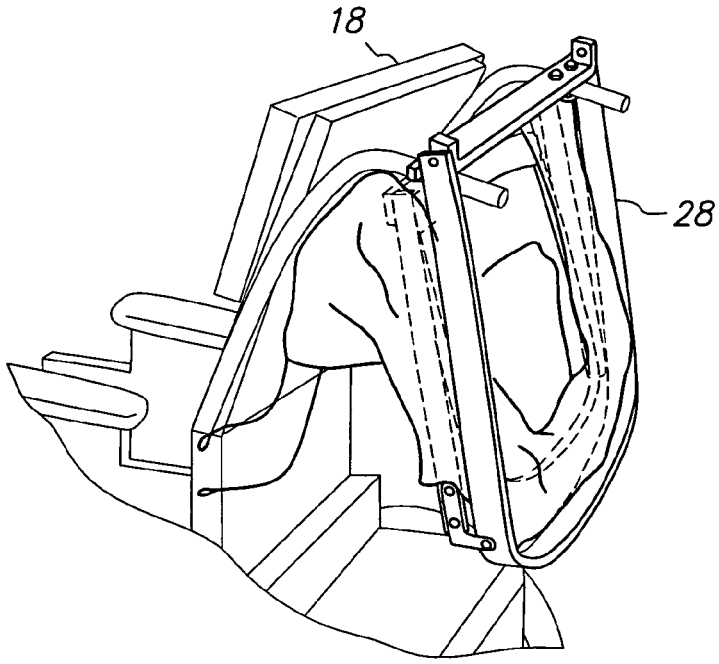
FIG. 6 is a view similar to FIGS. 4 and 5 showing the embodiment of the invention of FIG. 2 in its stowed position.

FIGS. 4 and 5 illustrate steps in the folding of the cover. As can be seen from FIG. 4, as the front component 29 of the top section is folded rearwardly, it takes the flexible covering 20 with the same. It is folded to be generally parallel to the top component 31. As a particularly salient feature of the instant invention, the front section 29 has a transverse with less than that of the back section 28 with the result that it fits within the width of such back section when the foldable cover of the invention is stowed. While this can be seen in FIG. 5 and FIG. 6 (which shows the foldable cover fully stowed) it is best illustrated in FIG. 8 which does not include the covering. This dimensional relationship aids in assuring that when the foldable cover is in its stowed position, it is a relatively compact arrangement.

As mentioned previously, the mount bar 23 assures that rigid securance to the wheelchair is achieved. As discussed previously, a pair of spaced groups of slots 24 accommodate Velcro straps or U bolts which extend around the two push handles of a wheelchair to enable the bar to be rigidly secured thereto. The cover itself is then pivotally connected to the bar, i.e., the back section 28 is so connected, to enable the cover to be moved from its protective position to its stowed position.

Figure 13:
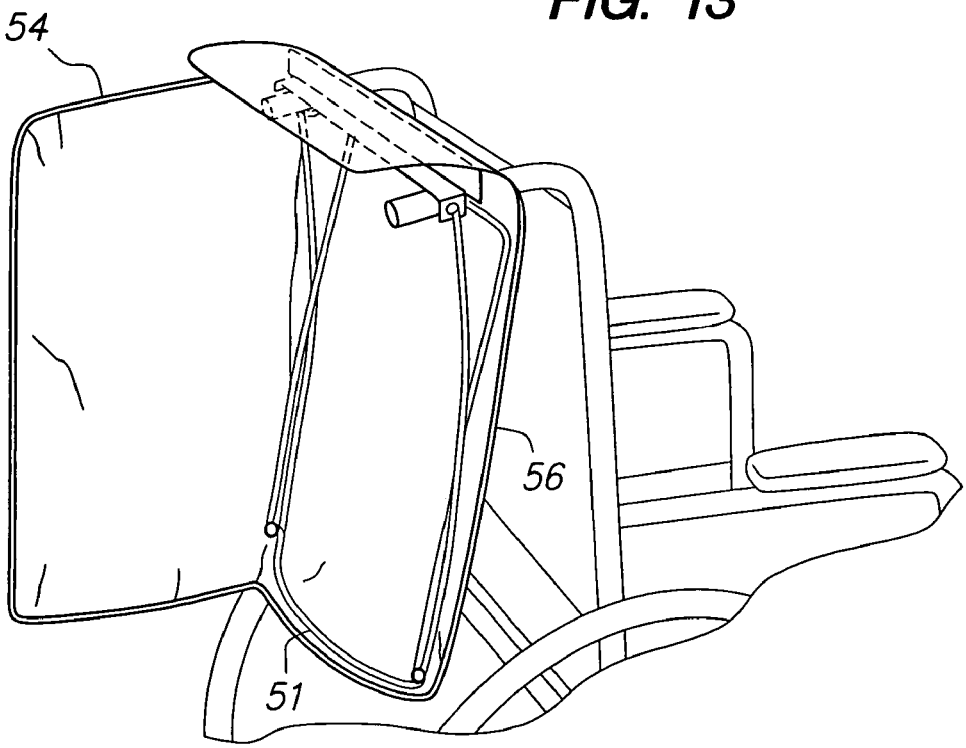

It will be seen from the above how the frame is designed not only to provide the desired foldability, but also to make sure that the full occupant space is covered. It is not necessary, though, that the top section be made up of a plurality of section components to provide the desired coverage. The embodiment of the invention shown in FIG. 1 is an example. Its frame is made from spring wire. More particularly, as is best shown in FIG. 13, the frame includes both a back section 41 out of spring wire and a front section 42 which is cantilevered therefrom. (By "spring" wire is meant wire which is flexible and "springs back" to its original position once the force which is responsible for the flexing is released.)

With reference to FIG. 1, the foldable cover of this embodiment is also an after market item and is rigidly secured to a regular push wheelchair 43 via a mount bar 44. (This mount bar 44 is different than the mount bar of the embodiment of FIG. 2 and will be described in more detail hereinafter.)

The foldable cover of the FIG. 1 embodiment is made up both of a covering 46 and the frame discussed previously. The covering is also either fully transparent or generally opaque with a window 47 as illustrated. Such covering is secured to the frame only at the front edge 48 and therefore follows the frame when it is erected but enables the frame (and cover) to be folded easily. The air vent provided by this embodiment is simple in that the window is secured only at the upper end of the same to the remainder of the covering by a standard hook-loop securing tape (not visible), such as that sold with the trademark Velcro. The result is that the full sides of the windows provide air vents. A simple hole 50 is provided in the center of the front of the cover so that the user can easily attach a bungee cord or the like to the front of the cover to keep it from being blown in a strong wind or the like.

Figure 10:
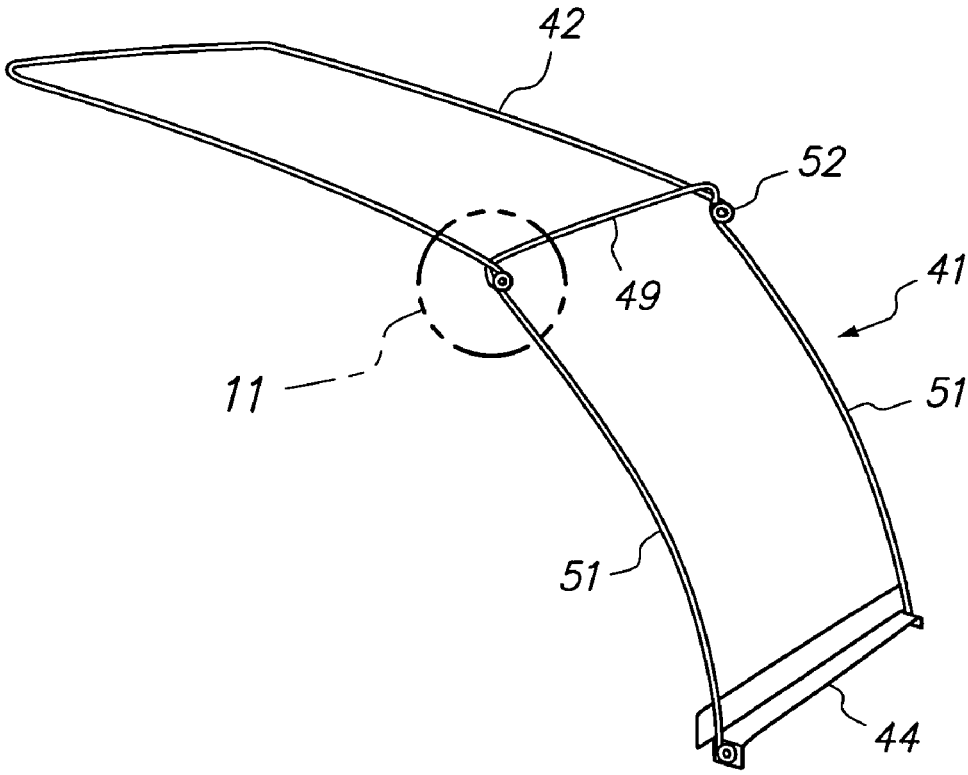
FIG. 10 is an isometric view of the frame arrangement of the embodiment illustrated in FIG. 1, similar to the showing in FIG. 1 of the frame of the embodiment shown in FIG. 2.

Reference is made to FIG. 10 for a better understanding of the frame of this embodiment. The back section 41 is of a one-piece construction of spring wire with a transverse portion 49 extending between its two elongated side portions 51.

Figure 11:
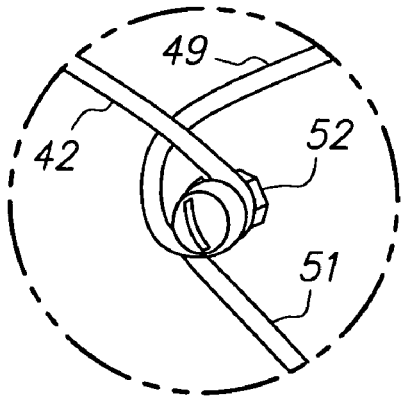
FIG. 11 is an enlarged view of that portion of the frame of the embodiment of FIG. 1 encircled in FIG. 10, illustrating the manner in which there is an interference position between the pivoting top section and the back section resulting in the desired cantilever.

The top section 42 is pivotally hinged to the back section via bolts 52. That is, with reference to FIG. 11, it is seen that the side portions 51 of the back section are folded around to make a loop through which bolts 52 extend. The spring wire of the back section then continues to form the transverse portion 49. The free ends of the spring wire making up the front section 42 are respectively secured around the bolts 52 as illustrated, and as a significant feature of the invention the construction results in the top section 42 being cantilevered from the back section. That is, as can be seen from FIG. 11 the transverse portion 49 of the back section interferes with pivoting motion of the top section 42 relative to the back section beyond the position which is shown. In other words, an interference position in each hinge connection is provided to assure that the cantilever is achieved. (It will be appreciated that although only one end is shown, the manner in which the other end of the top section interacts with the back section is simply a mirror image of that shown.) As illustrated, ties are provided to enable the forward lower end of the cover to be secured on each side to the wheelchair arms. This arrangement helps to maintain the cover in place when it is erected.

As mentioned previously, the covering is only secured to the frame at the front edge of the foldable cover. The result is that when the top section of the frame is pivoted or folded to the stowed position in the direction of the arrow 53 in FIG. 12, the covering 46 falls away from the same and simply follows the frame. The transverse width of the top section of the frame is slightly less than the transverse width of the back section defined by the wire portion 51 to thereby facilitate folding.

Figure 12:
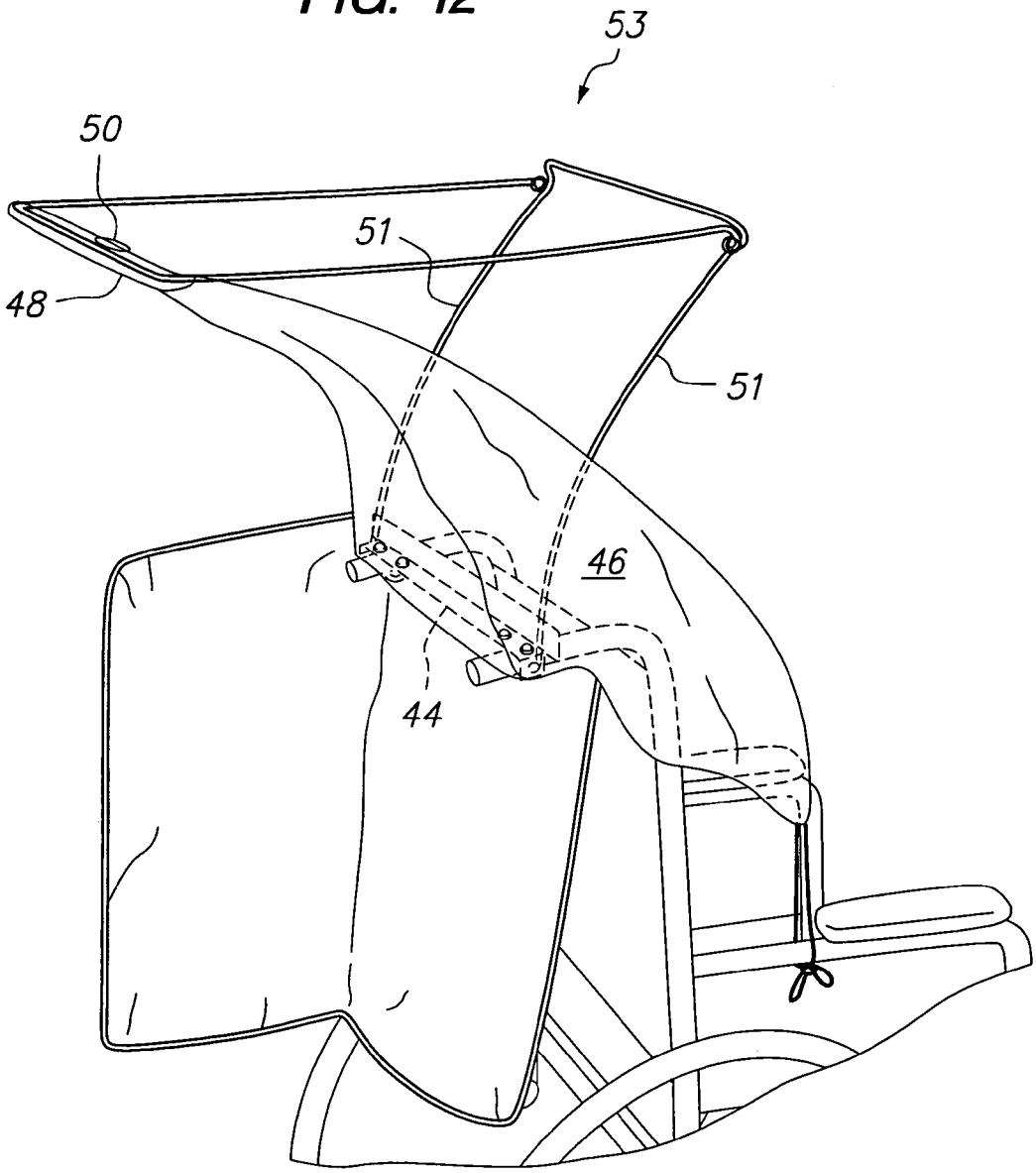
FIGS. 12 and 13 are partial isometric views similar to FIGS. 4 and 5 showing the embodiment of FIG. 1 in stages of being moved to its stowed position, FIG. 13 showing the same in almost its stowed position.
Figure 14:
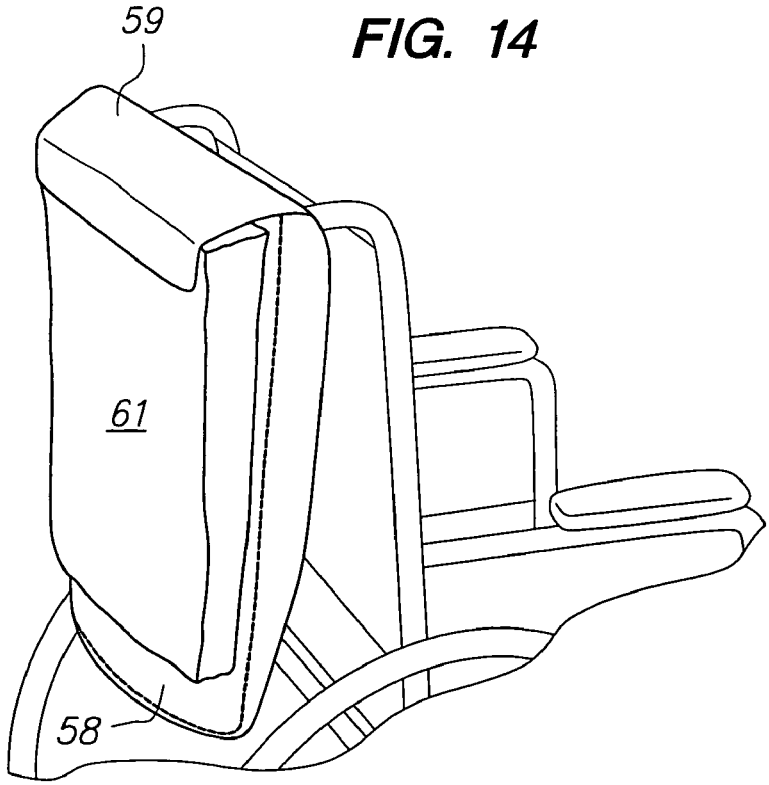
FIG. 14 is a partial elevation view of the cover of FIG. 2 completely stowed.

FIG. 12 shows an intermediate position when the cover of the invention is being folded to the stowed or stored position. The back section of the frame is pivotally connected to the mount bar 44 so that the whole construction can be folded into the collapsed portion illustrated in FIG. 13. This embodiment is different than the earlier embodiment in that it includes a bag enclosure 54 for housing the cover when it is in its stowed position. This bag enclosure is made up of front and back panels with the front panel permanently secured along an edge (the edge opposite edge 56) to the back panel, and the front panel is wrapped around the cover to the edge 56; the bottom of the enclosure being closed by a zipper (not shown) which extends upward along the edge 56 to thereby secure the front panel 58 of the bag enclosure to the back panel. The result of this construction is that the bottom and both sides of the bag enclosure are enclosed. A flap 59 (FIG. 14) is provided to close the top portion and provide complete protection for the foldable cover of the invention when it is stowed. It should be noted that while for clarity purposes, in FIG. 12 and FIG. 13 the front panel 58 of the bag enclosure is shown extending outward from the back panel, as a practical matter when the foldable cover of the invention is erected, the front panel is simply zipped to the back panel to thereby provide an empty bag enclosure and for clarity purposes, the bag enclosure is not shown in FIG. 1.

The front panel 58 of the enclosure is provided with a pouch 61 for the occupant to carry various items, such as groceries. It should be noted that the flap 59 extends over the opening into the pouch.

A sun visor or the like similar to those provided in automobiles can be provided on the front of the cover to enable the occupant to obtain shade as desired.

Figure 15:
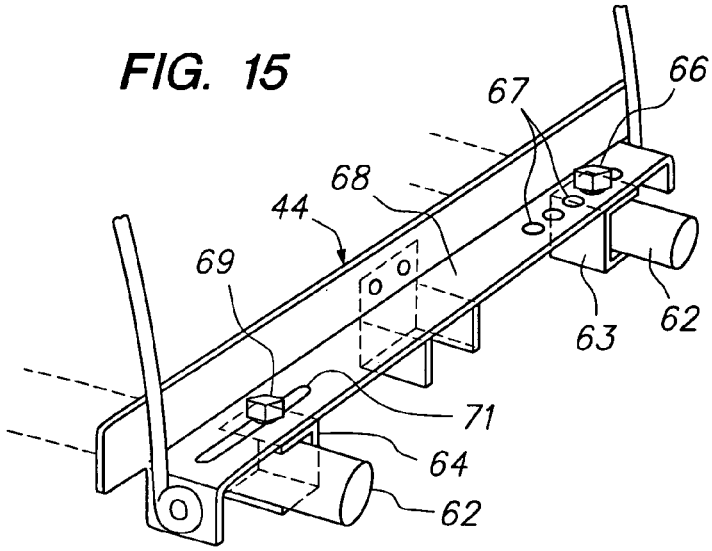
FIG. 15 is an enlarged isometric view of the mount bar of the FIG. 1 embodiment.

As mentioned previously, the mount bar 44 of this embodiment is different than the mount bar of the other earlier described embodiment. As shown in FIG. 15, such mount bar is similar to the earlier mount bar in that it extends between the push handles 62 of the chair to which the foldable cover is secured. However, it differs in that it includes a pair of opposed U-shaped clamps 63 and 64 maintaining the same in position on the push bars. Clamp 63 is held rigidly in position by a bolt 66 extending through one of a plurality of holes 67. In contrast, the clamp 64 is secured to the remainder of the mount bar 68 via a bolt 69, which extends through a slot 71. The result of this construction is that a quick release mechanism is provided on the mount bar for selectively providing the rigid securance to a wheelchair. In this connection, when the mount bar is initially installed, the bolt 66 is tightened through an appropriate one of the holes 67 to center the mount bar, and then the bracket 64 is slipped on the other push handle 62 to locate the same for the rigid securance; then the bolt 69 is tightened. It will be appreciated that with this arrangement to remove the mount bar and, hence, the foldable cover from the chair it is only necessary to loosen the bolt 69 and slide the bracket 64 to disengage the same from its respective handle and the full mount bar from the chair.

Figure 16:
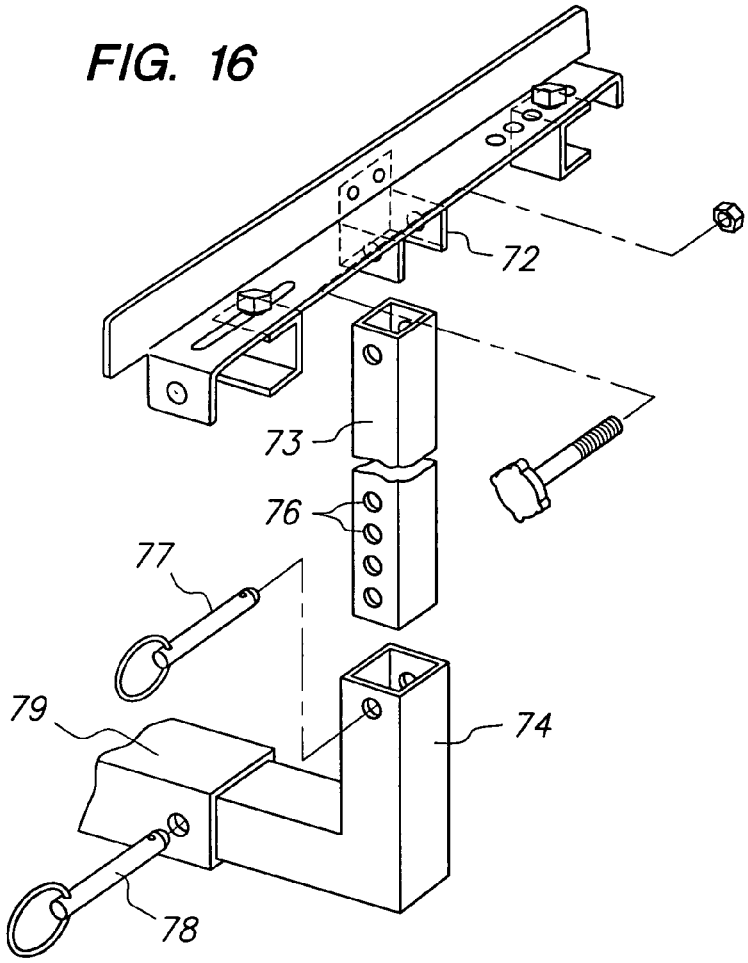
FIG. 16 is a view similar to FIG. 15 of the mount bar showing an attachment for securing the foldable cover of the invention to a wheeled vehicle such as a scooter designed for use by the disabled.

Mount bar 44 is quite versatile and can be used to mount the foldable cover (or any other desired structure) to other vehicles, such as the scooters typically used by the disabled. As shown in FIG. 16 the mount bar includes a bracket 72 designed to mate with and be secured to a channel extension 73. Such extension is designed to be adjustably received within an L-shaped connector 74 and, in this connection, a plurality of holes 76 are provided for interaction with a pin 77 to enable one to select an appropriate height. The L-shaped connector 34 is, in turn, held by a pin 78 within a receiver 79 of the type typically found at the rear of scooters and the like.

It will be recognized from the above that this embodiment is particularly lightweight and is therefore especially useful with push chairs. Moreover, the foldable cover of the invention is easily moved between the fully upright condition and a stowed position.

As mentioned at the beginning of the detailed description, applicant is not limited to the specific embodiments and variations described above. For example, it may be desirable to provide two different coverings for a single foldable cover of the invention, one covering being fully transparent for use in storms and the like (provide protection without interfering with visibility) and one generally opaque for protection from the sun. It will also be recognized that the cover of the invention can be used with other wheeled vehicles. It is not limited to use with those designed for the disabled. The claims, their equivalents, and their equivalent language define the scope of protection.

What is claimed is:

1. A foldable cover for the overhead protection of an occupant of a wheeled vehicle, which cover is storable on the wheeled vehicle when no in use in a position facilitating erection to provide said overhead protection, the cover comprising:

A. A frame having at least two sections: a back section and a top section cantileverable from said back section over the normal space provided by said vehicle for said occupant, said frame being rigidly securable to said vehicle with said back section pivotally connected for switching said cover between a stowed position on said vehicle and a protective position covering the occupant space; and B. A flexible covering supported by said frame sections wherein said top section includes a pair of components, the front section component of said two top section components having a transverse width sized to fit within the transverse width of said back section when said foldable cover is in said stowed position.

2. The foldable cover of claim 1 wherein a hinge securance of said top section to said back section is provided, which hinge securance includes an interference position between frame members which provides a cantileverable relationship between said back and top sections.

3. The foldable cover of claim 1 wherein said frame is made up of polyethylene plastic bars.

4. The foldable cover of claim 1 wherein said frame is made up of a plurality of spring wires.

5. The foldable cover of claim 1 wherein the other of said two top section component is a midsection sandwiched between said back section and said front section component, said midsection being hingedly secured to said back section for pivotal movement between a stowed position generally adjacent said back section and said cantilevered position in which said two top section components are cantilevered serially from said back section over the normal space provided by said vehicle for said occupant.

6. The foldable cover of claim 1 further including a mount bar which is an intermediate between said frame and said vehicle; said mount bar being adapted for rigid securance to said wheeled vehicle, and the back section of said frame being pivotally secured to said mount bar for switching said cover between said stowed position and said protective position.

7. The foldable cover of claim 6 wherein said mount bar includes means for securance of said back section to differing wheeled vehicles.

8. The foldable cover of claim 7 wherein said means for securance is a quick release mechanism.

9. The foldable cover of claim 1 in which one or more air vents are provided in the covering.

10. The foldable cover of claim 1 wherein said flexible covering is transparent.

11. The foldable cover of claim 1 wherein said flexible covering is generally opaque but includes a transparent window at the location for the back of the head of an occupant of said vehicle.

12. A foldable cover for the overhead protection of an occupant of a wheeled vehicle, which cover is storable on the wheeled vehicle when no in use in a position facilitating erection to provide said overhead protection, the cover comprising:

A. A frame having at least two sections: a back section and a top section cantileverable from said back section over the normal space provided by said vehicle for said occupant, said frame being rigidly securable to said vehicle with said back section pivotally connected for switching said cover between a stowed position on said vehicle and a protective position covering the occupant space; and B. A flexible covering supported by said frame sections wherein said top section includes a pair of components, the front section component of said two top section components having a transverse width sized to fit within the transverse width of said back section when said foldable cover is in said stowed position wherein a bag enclosure is provided for enclosing the foldable cover when it is in its stowed position.

13. A frame for a foldable cover for the overhead protection of an occupant of a wheeled vehicle, said frame having at least two sections: a back section and a top section hingedly secured to said back section and cantileverable therefrom over the normal space provided by said vehicle for said occupant wherein the top section has two components, one of which is a front section component having a transverse width sized to fit within the transverse width of said back section when said foldable cover is in its stowed position.

14. The frame of claim 13 wherein said top section has two top section components, one of which is a midsection sandwiched between said back section and the other of said two top sections, said midsection having a hinge securance to said back section that includes an interference position between frame members providing a cantilevered position.

15. The frame for a foldable cover of claim 13 further including a mount bar in combination with said frame adapted to rigidly secure said back section and, hence, the remainder of said foldable cover to said vehicle; said back section being pivotally connected to said mount bar for movement between a stowed position and a protection position in which said back section and said cantilevered top section cooperate to cover the space for an occupant of said wheeled vehicle.

16. The frame of claim 13 wherein the other of said two top section components is a midsection sandwiched between said back section and said front section component; said midsection being hingedly secured to said back section for pivotal movement between a folded position generally adjacent said back section and said cantilevered position in which said two top sections are cantilevered from said back section in a serial fashion over the normal space provided by said vehicle for said occupant.

* * * * *